US007632053B2

(12) United States Patent
Mätzler et al.

(10) Patent No.: US 7,632,053 B2
(45) Date of Patent: Dec. 15, 2009

(54) METHOD FOR THE PRODUCTION OF A SCREW, AND SCREW PRODUCED ACCORDING TO SAID METHOD

(75) Inventors: Thomas Mätzler, Rebstein (CH); Ernst Rohner, Thal (CH)

(73) Assignee: SFS-Intec Holding AG, Heerbrugg (CH)

( * ) Notice: Subject to any disclaimer, the term of this patent is extended or adjusted under 35 U.S.C. 154(b) by 0 days.

(21) Appl. No.: 10/535,694

(22) PCT Filed: Dec. 17, 2003

(86) PCT No.: PCT/EP03/14384

§ 371 (c)(1),
(2), (4) Date: May 19, 2005

(87) PCT Pub. No.: WO2004/059016

PCT Pub. Date: Jul. 15, 2004

(65) Prior Publication Data

US 2006/0078403 A1 Apr. 13, 2006

(30) Foreign Application Priority Data

Dec. 23, 2002 (DE) ..... 102 60 828

(51) Int. Cl.
*F16B 35/06* (2006.01)
*C22C 38/08* (2006.01)
*B21D 53/24* (2006.01)

(52) U.S. Cl. ..... 411/403; 148/587; 148/336; 420/95

(58) Field of Classification Search ..... 411/403, 411/424; 148/587, 336; 420/95; 470/8
See application file for complete search history.

(56) References Cited

U.S. PATENT DOCUMENTS

| | | | | | |
|---|---|---|---|---|---|
| 960,244 | A | * | 6/1910 | Allen | 470/16 |
| 1,244,125 | A | * | 10/1917 | Parish | 470/14 |
| 1,978,371 | A | * | 10/1934 | Purtell | 470/15 |
| 2,084,079 | A | * | 6/1937 | Clark | 411/403 |
| 2,182,092 | A | * | 12/1939 | O'Leary | 470/9 |
| 2,977,838 | A | * | 4/1961 | Oestereicher | 411/403 |
| 3,304,561 | A | * | 2/1967 | Ellsworth | 470/63 |
| 3,811,872 | A | * | 5/1974 | Snape | 420/585 |
| 3,904,445 | A | | 9/1975 | Gallagher, Jr. | |

FOREIGN PATENT DOCUMENTS

| | | |
|---|---|---|
| DE | 29 29 179 | 1/1980 |
| GB | 1 535 775 | 12/1978 |
| GB | 2 337 477 | 11/1999 |
| WO | WO 94/13842 | 6/1994 |

OTHER PUBLICATIONS

ASM Handbooks Online, "Maraging Steels", 2002.*
Handbuch der Fertigungstechnik, Umformen, Carl Hanser Verlag München Wien, 1987 pp. 968-970.

* cited by examiner

*Primary Examiner*—Flemming Saether
(74) *Attorney, Agent, or Firm*—Volpe and Koenig, P.C.

(57) ABSTRACT

A screw (1) having a head (2), a shaft (4) that includes a thread (5), and an interior engaging member (3) in the head is provided. The screw (1) is produced from an ultra-high strength steel using a cold forming method.

4 Claims, 2 Drawing Sheets

METHOD FOR THE PRODUCTION OF A SCREW, AND SCREW PRODUCED ACCORDING TO SAID METHOD

BACKGROUND

The invention relates to a method for the production of a screw, in particular a screw for indexable inserts, provided with an interior engaging member and a screw.

The production of screws by way of cold forming of a source material has been known per se in several variants. Problems only arise with high-strength source material. Here, it has previously been understood that exclusively cutting, i.e. production by way of material removal can be used. Such a production of screws entails a high expense and is therefore very costly. Those skilled in the art still believe that beyond a certain level of strength of the source material, the production of screws with an interior engaging member by way of cold forming is impossible, particularly for relatively small screws.

SUMMARY

The object of the present invention is to overcome the prior mindset of those skilled in the art and to provide the ability for producing screws with an interior engaging member made from a high-strength material.

This is attained according to the invention in a method, in which ultrahigh-strength steel is used and in which a screw including the interior engaging member is produced by cold forming of the source material.

Through a series of experiments it has been determined that those skilled in the art were erroneous in the prior belief, based on seemingly impossible facts, and that it is actually quite possible to produce screws made from ultrahigh-strength steel using a method of cold forming according to the invention. Such screws have considerably better strength characteristics in reference to screws made by cutting due to the best possible cross-section ratios. In the previously used production method, the wrench socket in the head could only be produced by way of predrilling and subsequently producing the contour of the wrench by way of punching. However, using the production method of cold forming, the contour of the wrench, e.g., a hexagon socket, is produced by way of a cold forming pressing process without any preliminary drilling. Therefore, the opening in the wrench socket requires considerably less depth than the same result achieved by the prior process, which includes predrilling. Therefore, the strength is considerably higher at the point of transition from screw head to shaft, because a lot more material thickness remains between the opening for the wrench socket and the exterior contour. Therefore, the weak spots that develop during cutting are avoided.

Accordingly, the best features for accepting strong torque and also for achieving great tensile strength result from a screw, in particular a screw with an interior engaging member, made from ultrahigh-strength steel and produced by way of cold forming and which can be used with indexable inserts.

Although attempts have already been made to produce screws from ultrahigh-strength steel, limits seemed to appear when an interior engaging member was also produced. The present invention overcomes the bias that was previously held by those skilled in the art.

It is particularly advantageous for such a method and a screw made according to such a method if the source material used is an ultrahigh-strength steel with the composition C 0.03, Mo 5.0,Ni 18.5, Co 8.5, Ti 0.6, Al 0.1, moiety Fe which is the same as 0.03% carbon, 5.0% molybdenum, 18.5% nickle, 8.5% cobalt, 0.6% titanium, 0.1% aluminum, and 67.27% iron. Particularly with such a composition, those skilled in the art previously thought that any production via cold forming would not be possible. The present invention proves the opposite.

BRIEF DESCRIPTION OF THE DRAWINGS

Additional features and particular advantages of the invention will be explained in greater detail in the following description using the drawings. They show.

DETAILED DESCRIPTION OF THE PREFERRED EMBODIMENTS

Figure 1:
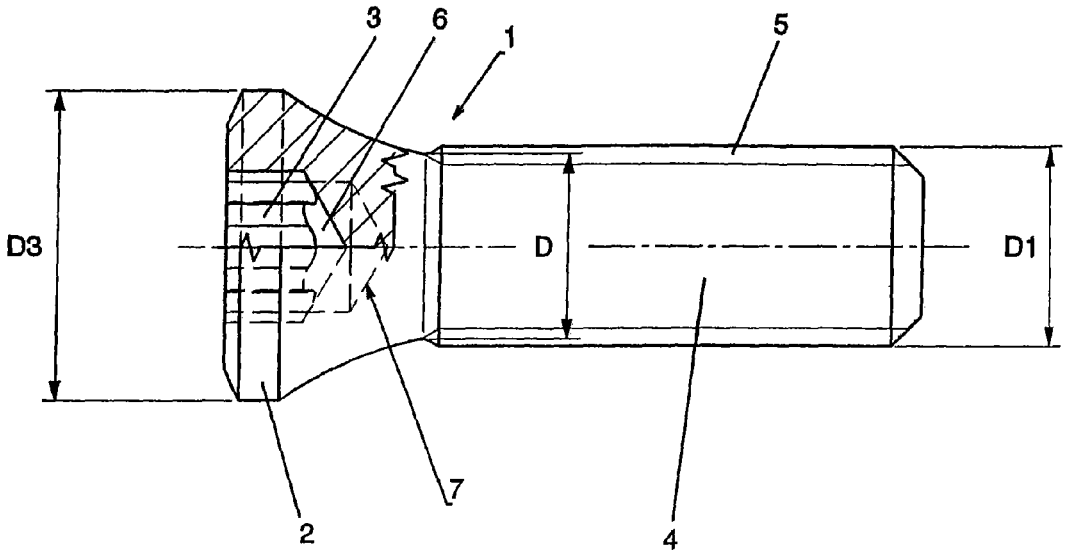
FIG. 1 a side view of a screw, shown partially cut open.
Figure 2:
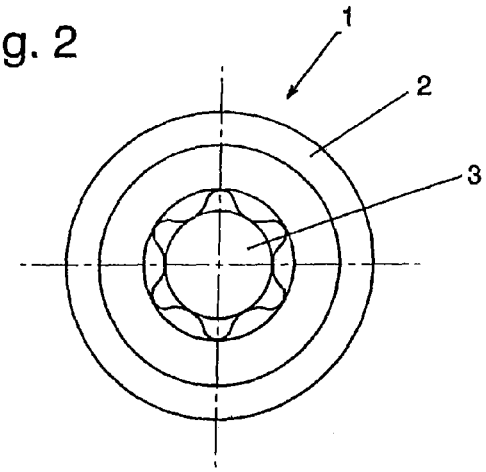
FIG. 2 a top view of the head of the screw.

In the drawing, an exemplary embodiment of a screw is shown that is used for fastening indexable inserts. The measures according to the invention can similarly apply to screws used for other purposes, of course. It has been shown particularly in screws, that have to be produced within narrow tolerances and are primarily subject to torque and tensile stress, that the screws made by way of cold forming are considerably better than screws made by cutting. Due to the fact that ultrahigh-strength steel are the best source material for such screws, such screws were previously made as turned parts, because one skilled in the art considered the production by way of cold forming being an impossibility.

A screw 1 shown in the drawing, made particularly for fastening indexable inserts, comprises a head 2 and a shaft 4 provided with a thread 5. On the shaft 4, having the diameter D, the thread 5 is rolled with the exterior diameter D1. The head 2 in the shape of a raised countersunk head, has a diameter D3. In the head 2 an interior engaging member 3 is formed for accepting a drive element. During the production in the cold forming process only a small indentation 6 is developed at the bottom of the interior engaging member 3. In the previously known production methods by way of cutting, a bore 7 (shown in dashed lines) had to be made first for producing the interior engaging member 3, formed as deep as necessary, in order to subsequently produce the wrench socket in a punching process. Based on the rather different sections having various diameters, a relatively large degree of formation must be considered with this being deemed not possible when ultrahigh-strength steel was used.

Figure 3:
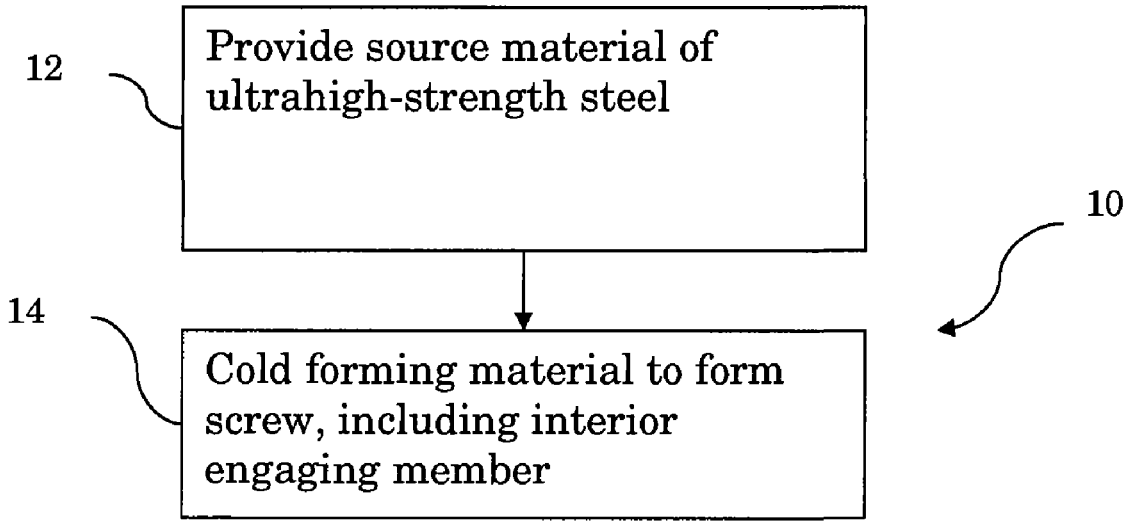
FIG. 3 is a flow chart showing a method of producing a screw using an ultrahigh-strength steel.

In the method according to the invention, indicated at 10 in FIG. 3, which is used for producing the screw, in particular a screw 1 for indexable inserts, the production occurs by way of cold forming of the source material, as indicated at 14, with ultrahigh-strength steel being used as the source material, as shown at 12, which used to be considered impossible by the experts. Within the scope of the invention any type of ultrahigh-strength steel can be processed by way of cold forming of the source material, however, in the present case, however a source material of an ultrahigh-strength steel with the composition C 0.03, Mo 5.0, Ni 18.5, Co 8.5, Ti 0.6, Al 0.1, moiety Fe is considered particularly suitable which is the same as 0.03% carbon, 5.0% molybdenum, 18.5% nickel, 8.5% cobalt, 0.6% titanium, 0.1% aluminum, and 67.27% iron.

This invention allows the production of a screw, in particular, a screw for indexable inserts, which comprises ultrahigh-strength steel and is made by way of cold forming. Therefore, essential improvements with regard to the strength of the screw are achieved.

The method for producing the screw uses additional processing steps, similar to the ones used in other cold forming methods, for example wash cycles, milling processes for chamfering, grinding, thread rolling, finishing, final quality control etc.

The invention claimed is:

1. A method for producing an indexable insert fastening screw, having an interior engaging member, the method comprising the steps of:

providing a source material of an ultra high-strength steel having a composition of 0.03% carbon, 5.0% molybdenum, 18.5% nickel, 8.5% cobalt, 0.6% titanium, 0.1% aluminum, and 67.27% iron;

cold forming the screw including the interior engaging member from the source material.

2. The method of claim 1, further comprising the step of forming an indentation at a first end of the source material.

3. The method of claim 2, wherein the indentation forms the interior engaging member in the head.

4. An indexable insert fastening screw consisting of a cold-formed monolithic head and shaft, an interior engaging member disposed within the head, the screw is formed from a source material of an ultra high-strength steel having a composition of: 0.03% carbon, 5.0% molybdenum, 18.5% nickel, 8.5% cobalt, 0.6% titanium, 0.1% aluminum, and 67.27% iron.

* * * * *